US006454539B1

(12) United States Patent
Santos

(10) Patent No.: US 6,454,539 B1
(45) Date of Patent: Sep. 24, 2002

(54) PERSONAL FAN SYSTEM

(76) Inventor: Joe Santos, 907 North Blvd., Universal City, TX (US) 78148

( * ) Notice: Subject to any disclaimer, the term of this patent is extended or adjusted under 35 U.S.C. 154(b) by 0 days.

(21) Appl. No.: 09/698,933

(22) Filed: Oct. 27, 2000

Related U.S. Application Data

(60) Provisional application No. 60/171,271, filed on Dec. 21, 1999, and provisional application No. 60/212,790, filed on Jun. 19, 2000.

(51) Int. Cl.[7] ..... F04B 49/06; F04B 53/00; F04B 17/00; B63H 1/00

(52) U.S. Cl. ..... 417/44.1; 417/44.5; 417/234; 417/423.15; 416/63

(58) Field of Search ..... 417/44.1, 44.5, 417/234, 423.15; 416/63; D23/370

(56) References Cited

U.S. PATENT DOCUMENTS 4,776,761 A * 10/1988 Diaz ..... 416/5
5,245,691 A * 9/1993 Wu ..... 392/365
5,252,795 A * 10/1993 Su ..... 200/61.52
5,304,035 A * 4/1994 Carter ..... 416/93
5,373,580 A * 12/1994 Shao ..... 392/366
5,667,731 A * 9/1997 Junkel et al. ..... 261/24
5,851,106 A * 12/1998 Steiner et al. ..... 416/63
6,161,777 A * 12/2000 Carter et al. ..... 239/222.11

* cited by examiner

*Primary Examiner*—Charles G. Freay
*Assistant Examiner*—Michael K. Gray
(74) *Attorney, Agent, or Firm*—Soules & Wallace, P.C.; Janice Leverett

(57) ABSTRACT

A personal fan generally comprises a source of electrical power such as, for example a power supply unit and a fan motor with one or more blades dependently supported by an adjustable arm. A tilt switch is provided for novel functionality for the personal fan, including the interruption of operation of the fan's blades while a user is drinking from an affixed cup or for activation of a provided light to indicate the need for replenishment of a beverage contained within the cup. A mounting assembly is provided for affixing the personal fan to a cup or mug, the brim of a hat or to any other desired structure in the proximity of a person who wishes to make use of the personal fan.

19 Claims, 9 Drawing Sheets

PERSONAL FAN SYSTEM

RELATED APPLICATION

This application claims, under 35 USC §119(e), all available benefit of the filing of U.S. provisional patent application Ser. No. 60/171,271 filed Dec. 21, 1999 and U.S. provisional patent application Ser. No. 60/212,790 filed Jun. 19, 2000. By this reference, the full disclosures, including the drawings, of U.S. provisional patent application Ser. No. 60/171,271 and U.S. provisional patent application Ser. No. 60/212,790 are incorporated herein as though now each set forth in its respective entirety.

FIELD OF THE INVENTION

The present invention relates to apparatus for personal comfort. More particularly, the invention relates to a personal fan as specifically adapted for use with a beverage container, a hat or cap or other personal item.

BACKGROUND OF THE INVENTION

Personal fans for use at sporting events and the like have been widely implemented. In at least one form, such fans have been integrated with drink holders and/or cups or mugs. Unfortunately, such implementations have failed to consider the safety of the user. To this end, it is a specific object of the present invention to improve over the personal fans of the prior art by providing a personal fan having an adaptation for preventing eye or other injury from the fan blades while the user is drinking from the cup or mug to which the personal fan is affixed. Likewise, it is an additional object of the present to provide such a personal fan that also includes provision for alerting a beverage vendor to the user's need for an additional beverage without the necessity for diverting the user's attention from the sporting event. In this manner, the user may enjoy the event and receive the maximum benefit of his or her ticket expenditure while also enjoying a favorite drink.

SUMMARY OF THE INVENTION

In accordance with the foregoing objects, the present invention—a personal fan—generally comprises a source of electrical power such as, for example a power supply unit and a fan motor with one or more blades dependently supported by an adjustable arm. The preferred embodiment of the present invention further comprises a tilt switch for providing novel functionality to the personal fan. Likewise, an appropriate mounting assembly is preferably provided for affixing the personal fan to a cup or mug, the brim of a hat or to any other desired structure in the proximity of a person who wishes to make use of the personal fan.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
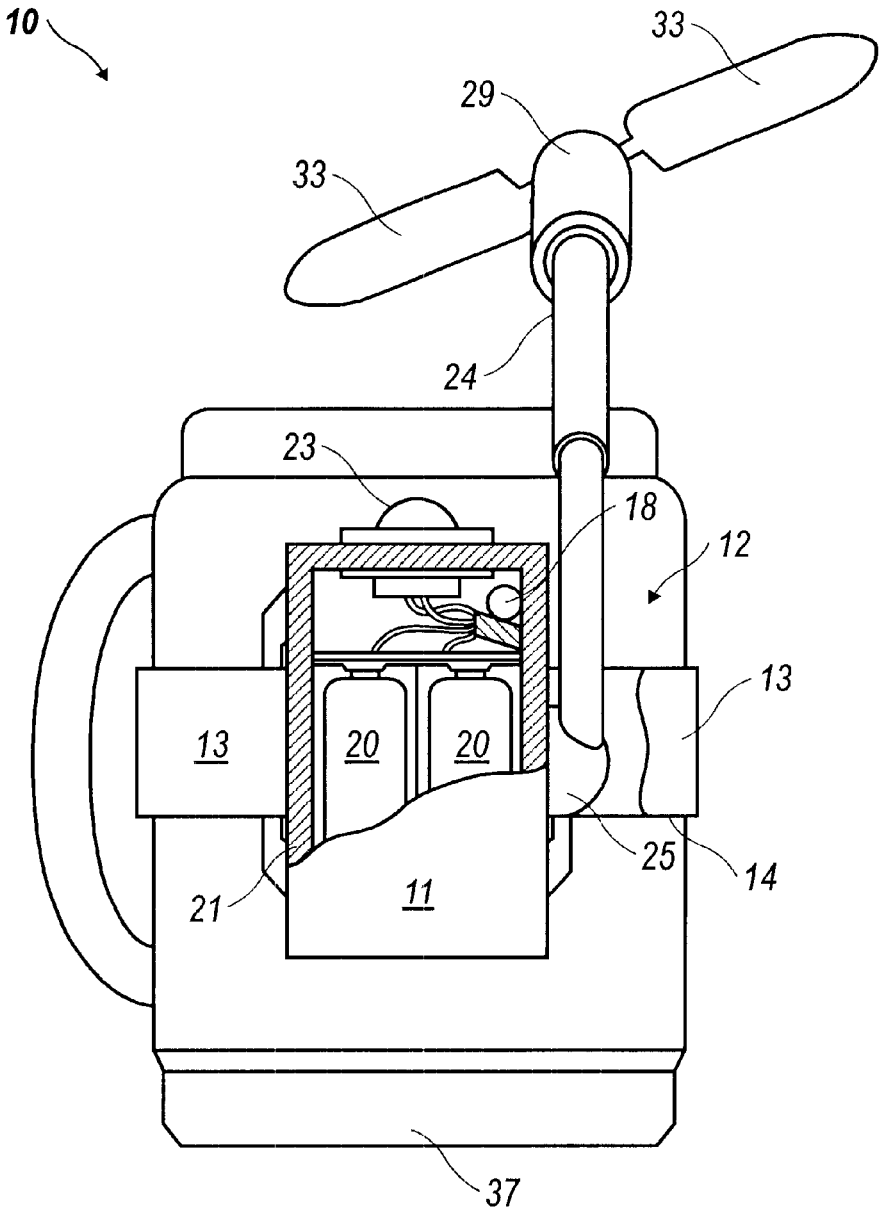
FIG. 1 shows a first preferred embodiment of the personal fan of the present invention.
Figure 2:
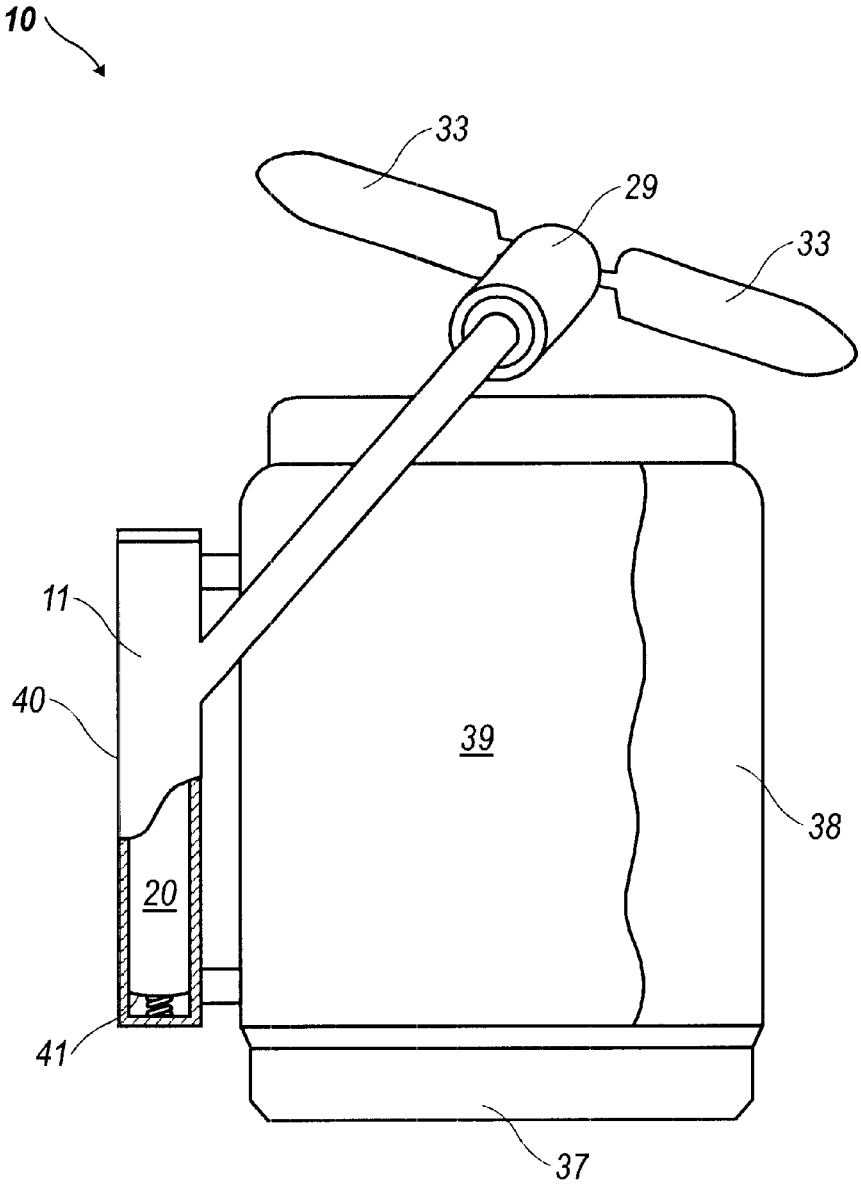
FIG. 2 shows a second preferred embodiment of the personal fan of the present invention.
Figure 4:
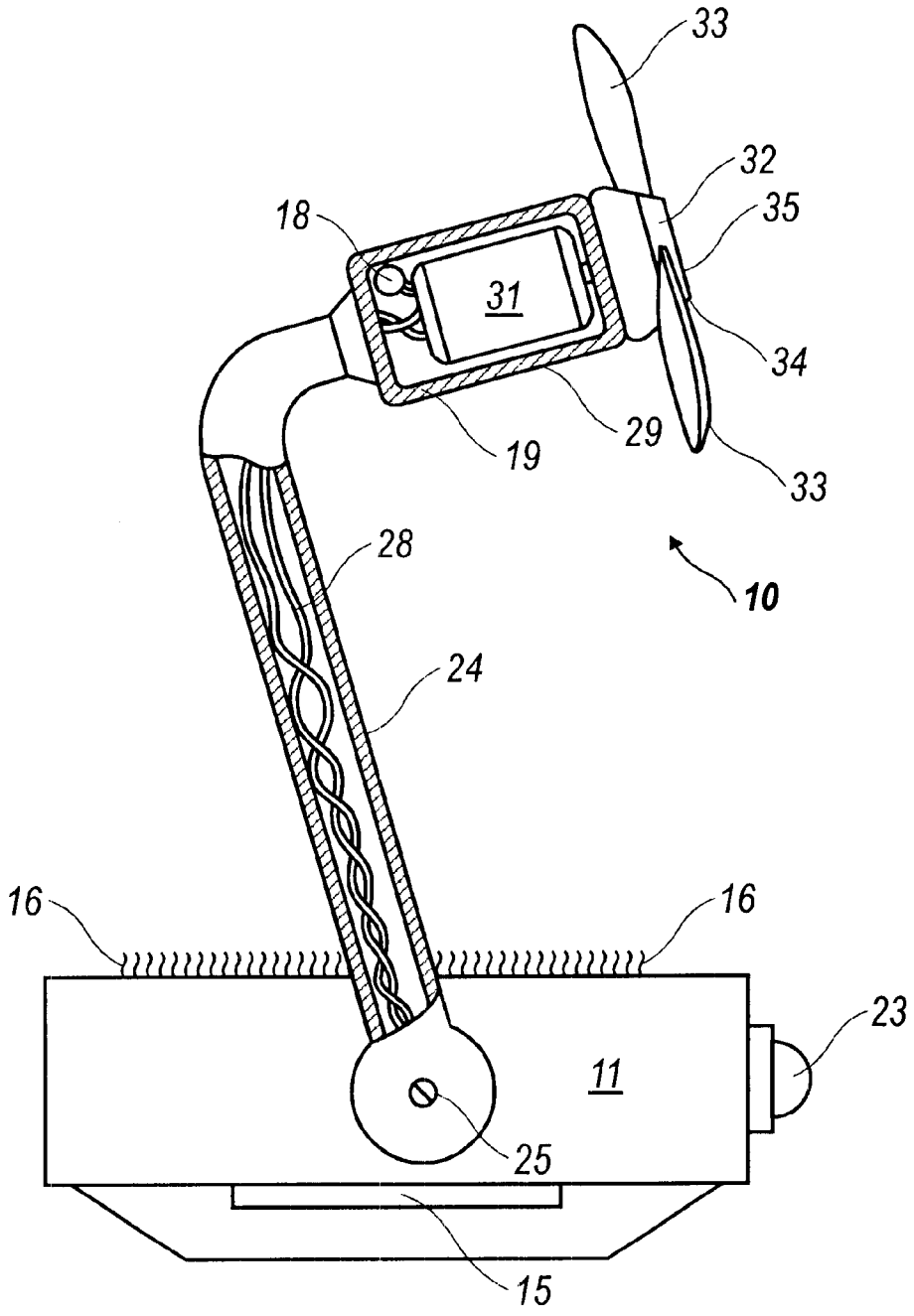
FIG. 4 shows, in a partially cut away view, additional details of the personal fan of FIG. 1.

Referring now to the figures, and FIG. 4 in particular, the preferred embodiment of the present invention—a personal fan 10—is shown to generally comprise a source of electrical power such as, for example a power supply unit 11 and a fan motor 31 with one or more blades 33 dependently supported by an adjustable arm 24. As will be better understood further herein, the preferred embodiment of the present invention further comprises a tilt switch 18 for providing novel functionality to the personal fan 10. Likewise, as shown in FIG. 1, an appropriate mounting assembly 12 is preferably provided for affixing the personal fan 10 to a cup or mug 37. In the alternative, as shown in FIG. 4, a clip assembly 17 or substantially equivalent structure may be provided for affixing the personal fan to the brim of a hat or to any other desired structure in the proximity of a person who wishes to make use of the personal fan 10.

Figure 3:
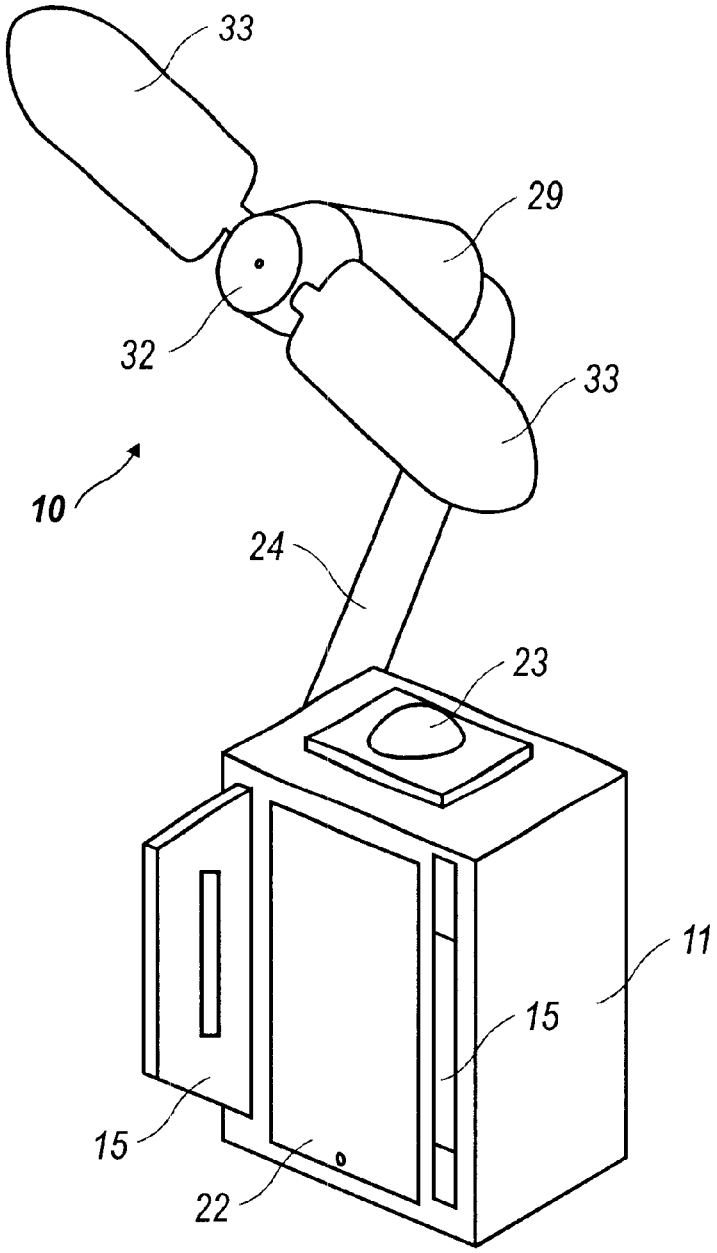
FIG. 3 shows details of the personal fan of FIG. 1.
Figure 5:
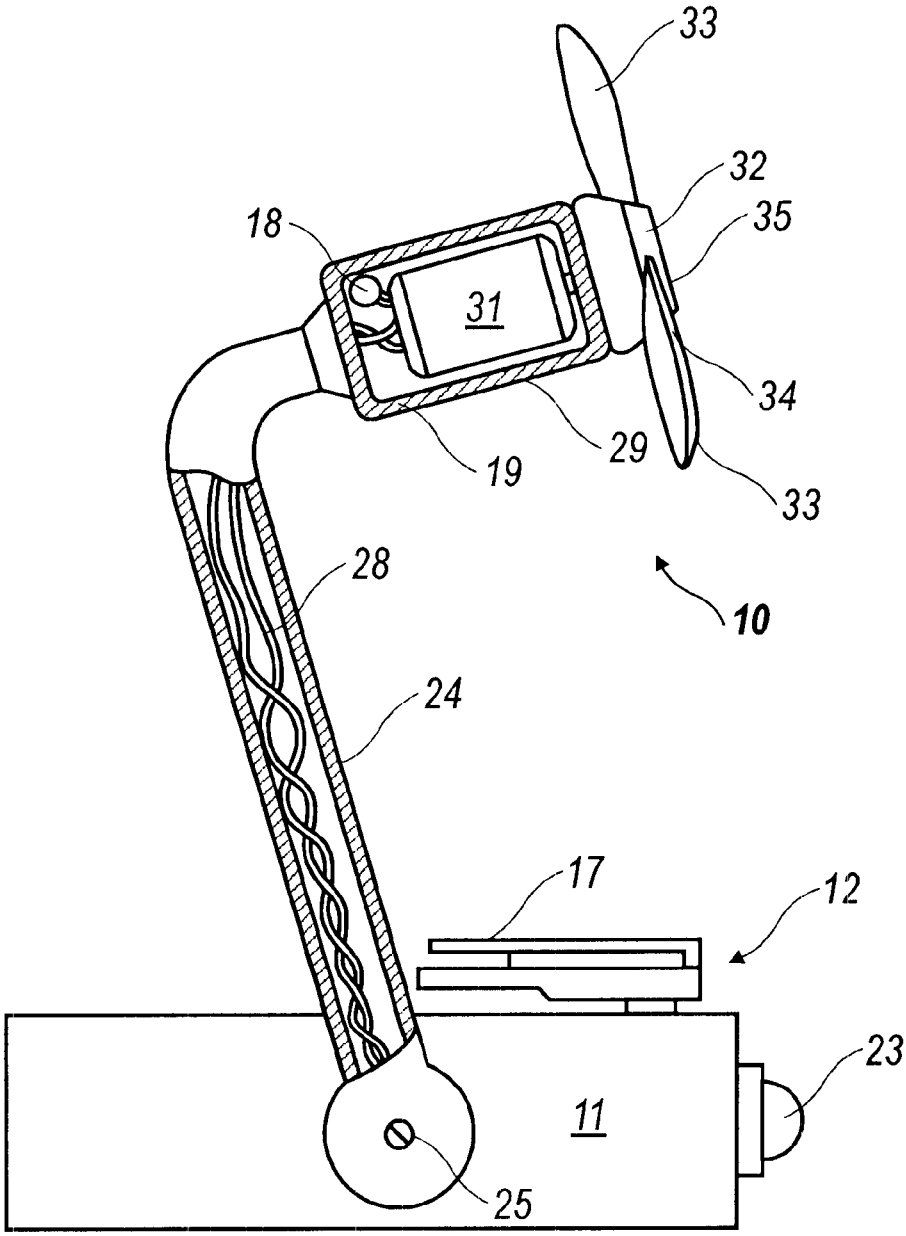
FIG. 5 shows a third preferred embodiment of the personal fan of the present invention.

As particularly shown in the embodiment of FIG. 1, the power supply unit 11 is preferably adapted to house one or more conventional batteries 20 within a conventional battery compartment 21. Additionally, those of ordinary skill in the art will recognize the substantially equivalent substitutions that may be made for conventional batteries such as, for example, solar cells. Preferably, a substantially water-tight access door 22 is provided over the battery compartment 21 for preventing the ingress of fluids to the battery compartment 21. In this manner, the operator may make use of the personal fan 10 without fear of spilling liquids from within the cup or mug 37 into the electrical components of the power supply unit 11. Also shown in FIG. 1, the mounting assembly 12 preferably comprises one or more straps 13 for releasable attachment of the personal fan 10 to a cup or mug 37 or the like. The straps 13, which preferably comprise an inexpensive fabric such as trademark "NYLON," may be provided with releasably engageable hook and loop type fasteners 14 such as are commonly available under the trademark "VELCRO." Additionally, it is preferred that the straps 13 are longitudinally stretchable in order to allow for the firm affixation of the power supply unit 11 to the cup or mug 37. In at least one embodiment, the power supply unit 11 comprises a plurality of elongated slots 15, which may take any of a variety of forms as shown in FIG. 3, for threading of the straps 13 through the power supply unit 11. Those of ordinary skill in the art will also recognize that other implementations for the mounting assembly 12, as shown in FIG. 5, are also possible. For example, as shown in FIG. 4, releasably engageable hook and loop type fasteners 16 may be directly affixed to the power supply unit 11 for mating with other hook and loop type fasteners permanently affixed to a cup or mug 37. Similarly, as shown particularly in FIG. 5, a clip assembly 17 may be provided on the power supply unit 11 for affixing the personal fan to the brim of a hat.

Figure 9:
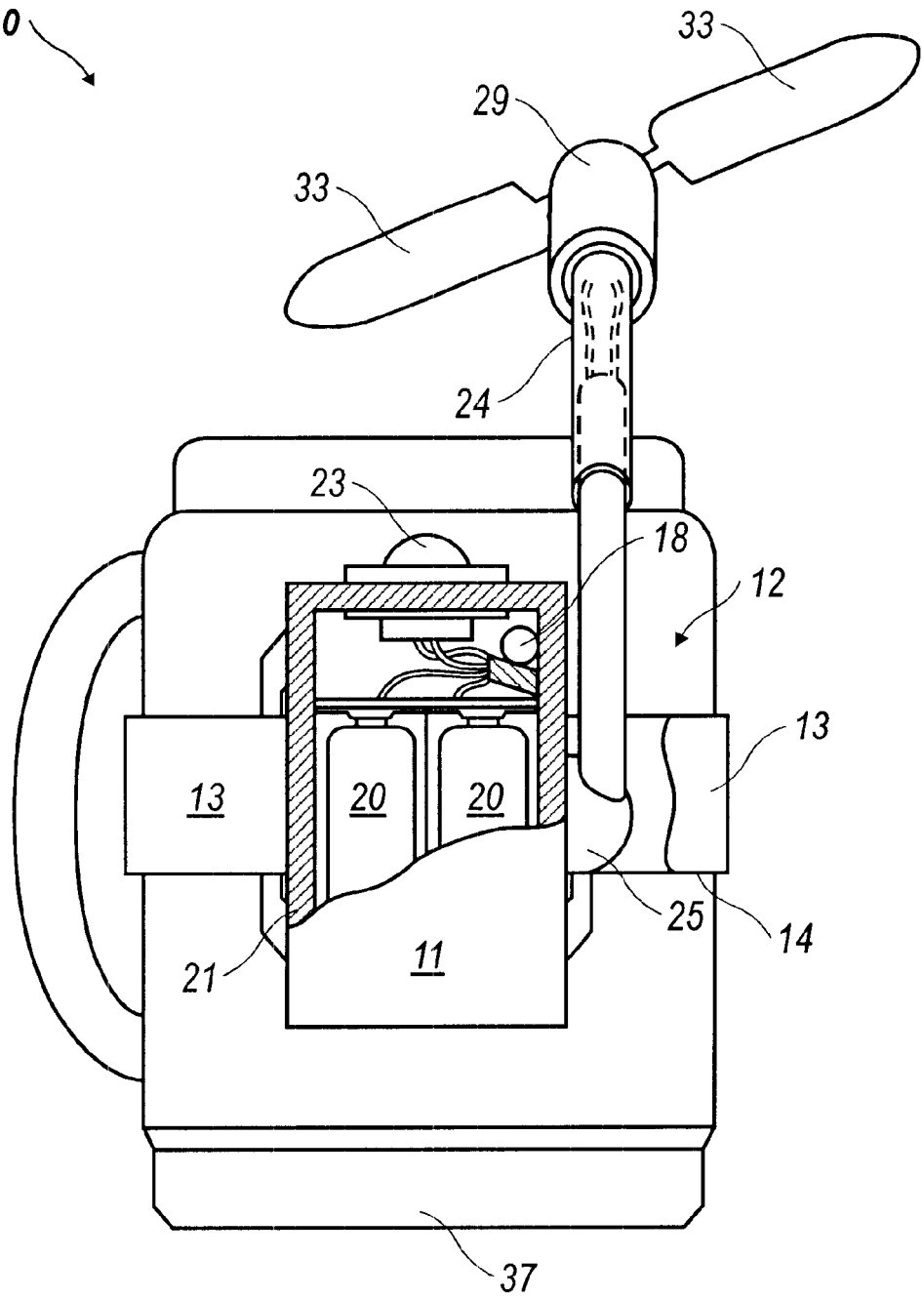
FIG. 9 shows the personal fan assembly of the present invention having a telescopically extendable arm.

As also shown in the various figures, the power supply unit 22 is preferably provided with a tilt switch 18 and an on-off switch 23. The tilt switch 18, which may comprise a mercury switch, a mechanical assembly or any other substantially equivalent device responsive to changes in the angular orientation of the power supply unit 11, is provided for activation of an indicator light, such a light emitting diode ("LED") or small bulb, or the deactivation of the fan motor 31, as will be better understood further herein. Additionally, those of ordinary skill in the art will recognize that such a switch may be utilized also to activate or deactivate other promotional devices such as, for example, recorded sound bites and the like. The indicator light 19 or recorded sound bite such as an audio recording may be provided on the power supply unit 11, the adjustable arm 24 or the motor casing 29 housing the fan motor 31, as shown in FIGS. 4, 5 and 9.

Figure 6:
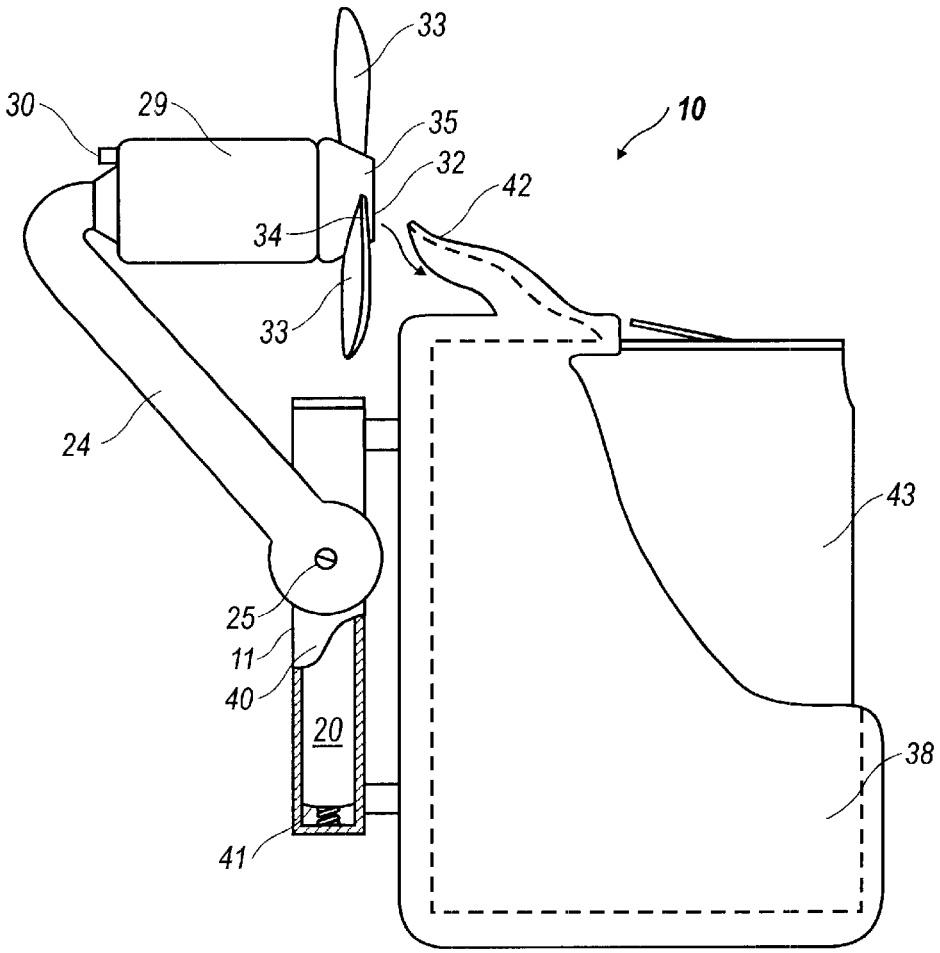
FIG. 6 shows a fourth preferred embodiment of the personal fan of the present invention.

In an alternative embodiment of the present invention, an insulated sleeve 38 may be provided for removable affixation over a cup or mug 37 or may be provided integral with a cup or mug 37. In the former case, the insulated sleeve 38 may comprise a cup 39 fastenable about the cup or mug 37 with hook and loop type fasteners or the substantial equivalent thereof. In this alternative embodiment, the insulated sleeve 38 may be easily provided with an integral handle 40 that may also comprise an internal battery compartment 41. In this case, the power supply unit 11 may be integrated within the handle 40, thereby reducing the overall weight of the personal fan 10 as well as the size thereof. In yet a further extension of the present invention, as shown particularly in FIG. 6, the insulated sleeve 38 may be formed to produce an airflow conduit 42 for direction of air from the blades 33 downward and over the surface of a beverage within a cup or mug 37 or aluminum can 43. In this manner, the cool beverage may be utilized to cool the forced air, thereby increasing the efficacy of the personal fan 10.

As shown in the various figures, the fan motor 31 is preferably housed in a motor casing 29 dependently supported upon the adjustable arm 24. In FIG. 9, the arm 24 incorporates two pieces, whereby a first piece has an end telescopically inserted into a housing of a second piece. The end of the first piece preferably has teeth designed to catch onto the lowermost portion of the housing of the second piece thereby preventing disconnection. One or more blades 33 are operably provided with the fan motor 31 through a prop spinner 32, which may be removable for compact storage of the personal fan 10. Likewise, the blades 33 may be affixed to the prop spinner 32 through hinges 34, thereby allowing for compact folding of the blades 33 about the motor casing 29. In this case, locking mechanisms 35 are preferably provided within the hinges 34 for securing the blades 33 in their extended position during operation of the fan motor 31 Such hinges 34 and locking mechanisms 35 are readily within the ordinary skill in the art.

Figure 7:
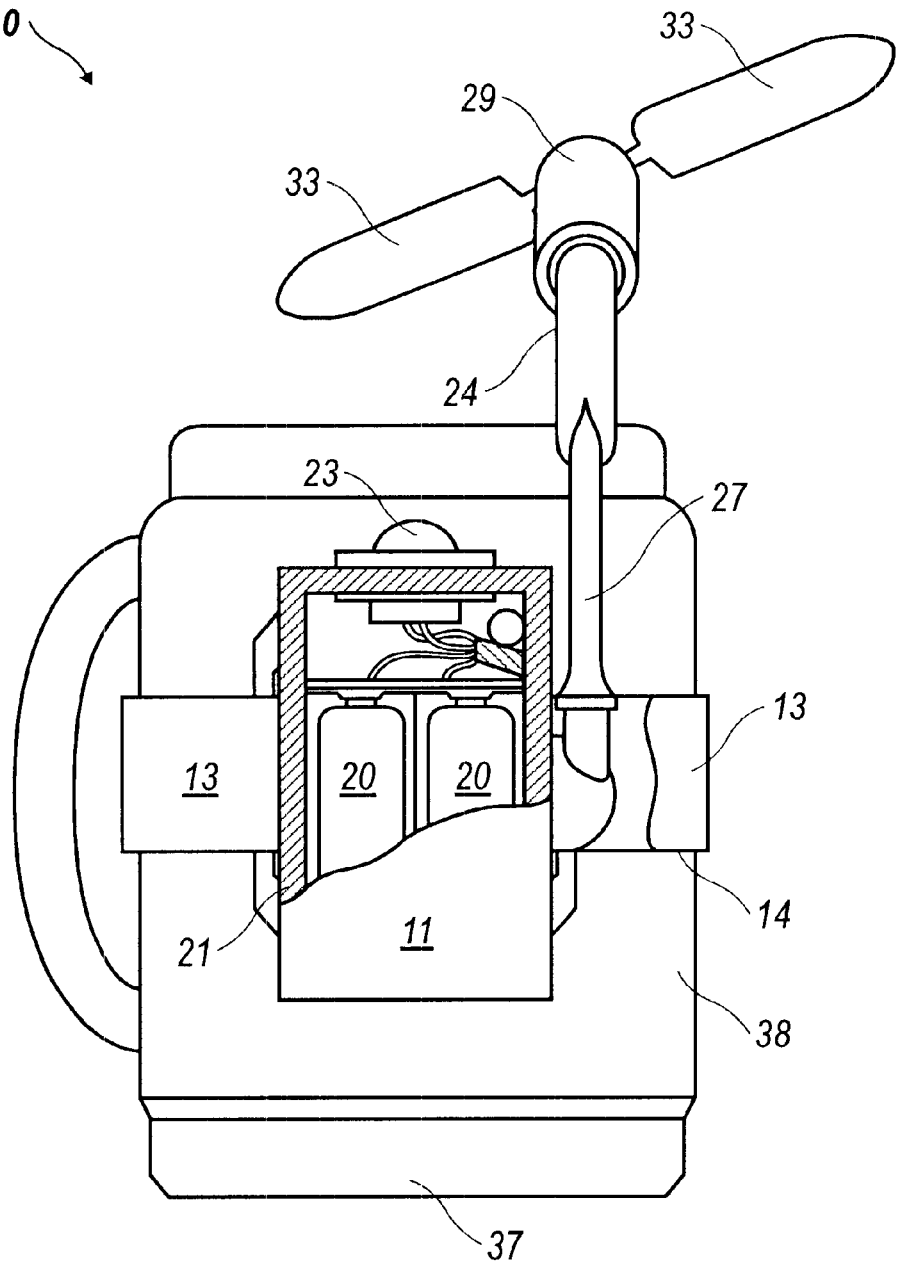
FIGS. 7 and 8 show alternative embodiments of a certain aspect of each of the preferred embodiments of the present invention.
Figure 8:
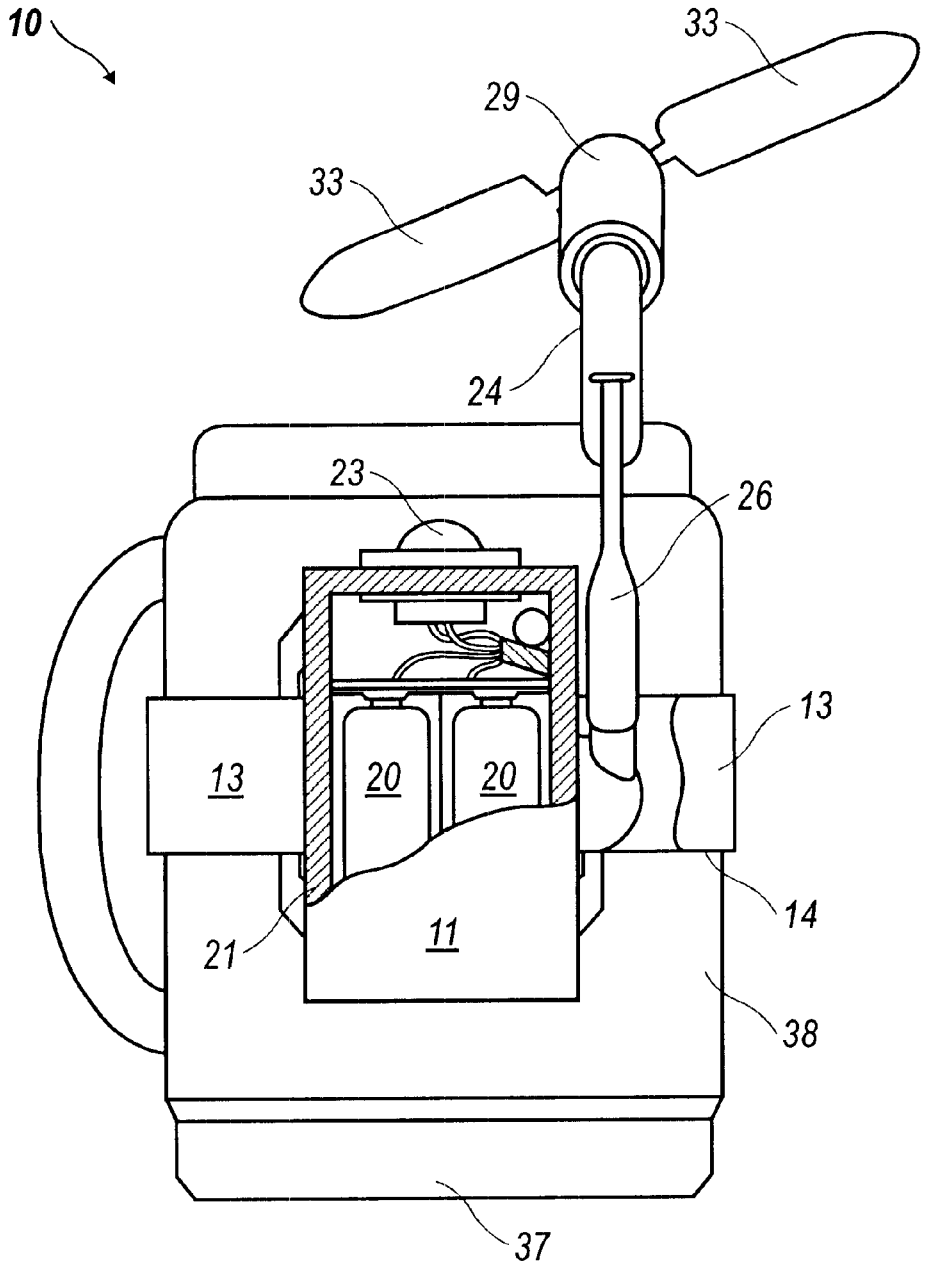

In the preferred embodiment of the present invention, the adjustable arm 24 is affixed to the power supply unit 11 or insulated sleeve 38 through a pivotal attachment 25. In this manner, the blades 33 of the personal fan 10 may be easily directed as desired by the operator. The adjustable arm 24 also preferably comprises a hollow shaft 28 therethrough in order to conveniently and inconspicuously contain the necessary wiring between the power supply 11 and fan motor 31. As shown particularly in FIGS. 7 and 8, the adjustable arm 24 may also be formed in various sports shapes such as the depicted baseball bat 26 and golf tee 27 to suit the personal preference of the user. Because it is envisioned that the present invention may find wide spread applicability in the advertisement of refreshment beverages, those of ordinary skill in the art will also recognize that the motor casing 29 and/or the power supply unit 11 may be shaped and provided with ornamentation reflective of a particular beverage product such as, for example, those sold under the well-known trademark "COCA-COLA."

For operation of the present invention, the tilt switch 18 is oriented and adapted to interrupt power from the power supply unit 11 to the fan motor 31 when the cup or mug 37 to which the personal fan 10 is attached is tilted for drinking therefrom. In this manner, the user may freely drink from the cup or mug 37 without fear of impact from the blades 33. Additionally, in the preferred embodiment of the present invention, the blades 33 comprise a foam, flexible rubber or other polymeric material as a further safety feature. The tilt switch 18 may also be further adapted to automatically activate the indicator light 19 when the cup or mug 37 is turned to a degree indicating the depletion or near depletion of the beverage contained therein. In this manner, a beverage vendor at, for example, an athletic event can readily identify a user in need of an additional beverage. As will be recognized by those of ordinary skill in the art, the indicator light 19 may also be adapted to remain on after its initial activation until reset by the user by, for example, depressing an additional push button switch 30.

While those of ordinary skill in the art will recognize that many materials of construction may be utilized for the implementation of the present invention, it is preferable that a light weight and inexpensive material be utilized in order that the personal fan 10 maybe distributed as widely as possible. To this end, a plastics or like material is preferred. It is also preferred that all electrical components of the present invention be housed in a substantially fluid impervious manner, thereby preventing damage to the personal fan 10 and consequently extending its useful product life. As a result weatherproof and/or water-tight switches should be used where possible. As is known to those of ordinary skill in the art, such switches are widely available from various manufacturers such as Clarostat of El Paso, Tex.; Honeywell of Freeport, Ill.; and NKK Switches of Scottsdale, Ariz. In the alternative, other manufacturers, such as APM of Hexseal of Mesa, Ariz., produce rubber boots and seals in many standard and custom forms for weatherproofing standard, off-the-shelf switches.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, the adjustable arm 24 may be telescopically extendable in order for use with a wide variety of cup or mug sizes. Likewise, the personal fan 10 may be implemented with an additional switch for reversing the operation of the fan motor 31, which is especially desirable when used in close proximity to a person's face. In any case, because the scope of the present invention is much broader than any particular embodiment, the foregoing detailed description should not be construed as a limitation of the scope of the present invention, which is limited only by the claims appended hereto.

What is claimed is:

1. A personal fan assembly comprising:

a power source being adapted for attachment to a personal item;

a fan being dependently affixed to and in electrical communication with said power source through an interposed arm;

a tilt switch adapted to interrupt said electrical communication upon a first angular deviation of said power source and providing an electrical communication between said power source and an indicator light upon a second angular deviation of said power source.

2. The personal fan assembly as recited in claim 1, wherein said personal item comprises a beverage holder.

3. The personal fan assembly as recited in claim 2, wherein said beverage holder comprises a drinking cup.

4. The personal fan assembly as recited in claim 2, wherein said beverage holder comprises an insulated sleeve, said insulated sleeve being adapted to conform about a beverage container.

5. The personal fan assembly as recited in claim 1, wherein said personal item comprises a hat.

6. The personal fan assembly as recited in claim 1, wherein said indicator light comprises a light emitting diode.

7. The personal fan assembly as recited in claim 1, wherein said indicator light is located adjacent said power source.

8. The personal fan assembly as recited in claim 1, wherein said indicator light is located adjacent said fan.

9. The personal fan assembly as recited in claim 1, wherein said indicator light is adapted to remain on after activation until deactivation by a user input.

10. The personal fan assembly as recited in claim 9, wherein said fan assembly further comprises a light switch for deactivation of said indicator light.

11. The personal fan assembly as recited in claim 1, wherein said arm is connected to said power source through a pivotal attachment.

12. The personal fan assembly as recited in claim 11, wherein said fan comprises a plurality of blades, each said blade being constructed of a substantially flexible material such that risk for injury concomitant contact with a user's flesh is effectively eliminated.

13. The personal fan assembly as recited in claim 12, wherein each said blade comprises a foam material.

14. The personal fan assembly as recited in claim 12, wherein each said blade is foldably attached to a main portion of said fan.

15. The personal fan assembly as recited in claim 11, wherein said arm is telescopically extendable.

16. The personal fan assembly as recited in claim 4, wherein said insulated sleeve comprises an airflow conduit, said airflow conduit being adapted to direct flow from airflow from said fan onto the surface of a beverage held by said beverage holder.

17. The personal fan assembly as recited in claim 5, said personal fan assembly further comprising a clip fixedly disposed upon said power source, said clip being adapted to secure said personal fan assembly to a hat brim.

18. The personal fan assembly as recited in claim 17, said personal fan assembly further comprising a reversing switch, said reversing switch being adapted to control operation of said fan to allow said fan to operate in a mode selected from the group consisting of blowing air toward a user's face and pulling air away from a user's face.

19. The personal fan assembly as recited in claim 1, wherein said tilt switch is adapted to interrupt said electrical communication upon said first angular deviation of said power source and providing said electrical communication between said power source and a recorded sound bite upon a second angular deviation of said power source.

* * * * *